US008616842B2

(12) United States Patent
Avedon

(10) Patent No.: US 8,616,842 B2
(45) Date of Patent: Dec. 31, 2013

(54) COLUMNAR AIR MOVING DEVICES, SYSTEMS AND METHOD

(75) Inventor: Raymond B. Avedon, Boulder, CO (US)

(73) Assignee: Airius IP Holdings, LLC, Longmont, CO (US)

( * ) Notice: Subject to any disclaimer, the term of this patent is extended or adjusted under 35 U.S.C. 154(b) by 960 days.

(21) Appl. No.: 12/724,799

(22) Filed: Mar. 16, 2010

(65) Prior Publication Data

US 2010/0266400 A1 Oct. 21, 2010

Related U.S. Application Data

(60) Provisional application No. 61/164,808, filed on Mar. 30, 2009, provisional application No. 61/222,439, filed on Jul. 1, 2009.

(51) Int. Cl.
*F04D 29/54* (2006.01)

(52) U.S. Cl.
USPC ..... 415/209.2; 415/209.4; 415/210.1; 415/211.2; 415/220; 415/222; 29/888.025; 454/230

(58) Field of Classification Search
USPC ..... 415/189, 190, 191, 192, 208.2, 209.2, 415/209.3, 209.4, 210.1, 211.2, 220, 222; 416/214 R, 219 A, 220 A, 207, 208, 416/212 R, 194, 196 R, 196 A; 29/888.025, 29/888.02, 889.3, 889.21, 889.22; 454/230, 231, 233, 310
See application file for complete search history.

(56) References Cited

U.S. PATENT DOCUMENTS

| | | | | |
|---|---|---|---|---|
| 917,206 | A | | 4/1909 | Watts |
| 1,858,067 | A | * | 5/1932 | Warren ..... 416/196 R |
| 1,877,347 | A | * | 9/1932 | McMurdie ..... 416/194 |
| 1,926,795 | A | | 9/1933 | Sassenberg |
| 2,016,778 | A | | 10/1935 | Hall et al. |
| 2,189,008 | A | | 2/1940 | Kurth |
| 2,189,502 | A | | 2/1940 | Johnston |
| 2,232,573 | A | | 2/1941 | Teves |
| 2,258,731 | A | | 10/1941 | Blumenthal |
| 2,359,021 | A | | 9/1944 | Campbell et al. |
| 2,366,773 | A | | 1/1945 | Eklund et al. |
| 2,371,821 | A | | 3/1945 | Havis |

(Continued)

FOREIGN PATENT DOCUMENTS

| | | |
|---|---|---|
| CN | 10 1592328 | 12/2009 |
| DE | 44 13 542 | 10/1995 |

(Continued)

OTHER PUBLICATIONS

Examiner's Third Report for Australian Application No. 2005227197, dated Mar. 30, 2011 in 2 pages.

(Continued)

*Primary Examiner* — Christopher Verdier
(74) *Attorney, Agent, or Firm* — Knobbe, Martens, Olson & Bear LLP

(57) ABSTRACT

A columnar air moving device can comprise separately formed modular stator vanes in a stator vane assembly. The stator vanes can be arranged in a radial pattern, and can direct air in an axial direction. The modular stator vanes, as well as other components of the stator vane assembly, can be replaced, adjusted, and/or removed from the columnar air moving device.

24 Claims, 10 Drawing Sheets

(56) References Cited

U.S. PATENT DOCUMENTS 2,513,463 A 7/1950 Eklund et al.
2,524,974 A 10/1950 Hickmott
2,632,375 A 3/1953 Stair et al.
2,658,719 A * 11/1953 Johanson ..... 415/209.4
2,830,523 A 4/1958 Vehige
3,012,494 A 12/1961 Drummond
3,036,509 A 5/1962 Babbitt
3,068,341 A 12/1962 Ortiz et al.
3,099,949 A 8/1963 Davidson
3,165,294 A 1/1965 Anderson
3,212,425 A 10/1965 Lindner et al.
3,246,699 A * 4/1966 Jocz ..... 29/889.6
3,300,123 A 1/1967 Freyholdt et al.
3,320,869 A 5/1967 Schach
3,364,839 A 1/1968 Sweeney et al.
3,413,905 A 12/1968 Johnson
3,524,399 A 8/1970 Bohanon
3,584,968 A * 6/1971 Keith ..... 415/210.1
3,690,244 A 9/1972 Kallel et al.
3,699,872 A 10/1972 Kruger
3,765,317 A 10/1973 Lowe
3,785,271 A 1/1974 Joy
3,827,342 A 8/1974 Hughes
3,835,759 A 9/1974 Lloyd
3,876,331 A 4/1975 DenHerder et al.
3,932,054 A 1/1976 McKelvey
3,934,494 A 1/1976 Butler
3,967,927 A 7/1976 Patterson
3,973,479 A 8/1976 Whiteley
3,988,973 A 11/1976 Honmann
4,006,673 A 2/1977 Meyer et al.
4,152,973 A 5/1979 Peterson
4,185,545 A 1/1980 Rusth et al.
4,261,255 A 4/1981 Anderson et al.
4,321,659 A 3/1982 Wheeler
4,344,112 A 8/1982 Brown
4,396,352 A 8/1983 Pearce
4,473,000 A 9/1984 Perkins
4,512,242 A 4/1985 Bohanon, Sr.
4,515,538 A 5/1985 Shih
4,522,255 A 6/1985 Baker
4,524,679 A 6/1985 Lyons
4,546,420 A 10/1985 Wheeler et al.
4,548,548 A 10/1985 Gray, III
4,550,649 A 11/1985 Zambolin
4,630,182 A 12/1986 Moroi et al.
4,662,912 A 5/1987 Perkins
4,678,410 A * 7/1987 Kullen ..... 415/210.1
4,681,024 A 7/1987 Ivey
4,715,784 A * 12/1987 Mosiewicz ..... 416/208
4,716,818 A 1/1988 Brown
4,730,551 A 3/1988 Peludat
4,790,863 A 12/1988 Nobiraki et al.
4,794,851 A 1/1989 Kurrle
4,848,669 A 7/1989 George
4,850,265 A 7/1989 Raisanen
4,890,547 A 1/1990 Wagner et al.
4,895,065 A 1/1990 Lamparter
4,930,987 A 6/1990 Stahl
4,971,143 A 11/1990 Hogan
4,973,016 A 11/1990 Hertenstein
5,000,081 A 3/1991 Gilmer
5,021,932 A 6/1991 Ivey
5,033,711 A 7/1991 Gregorich et al.
5,042,366 A 8/1991 Panetski et al.
5,078,574 A 1/1992 Olsen
5,107,755 A 4/1992 Leban et al.
5,121,675 A 6/1992 Muller et al.
5,127,876 A 7/1992 Howe et al.
5,152,606 A 10/1992 Borraccia et al.
5,156,568 A 10/1992 Ricci
5,191,618 A 3/1993 Hisey
5,328,152 A 7/1994 Castle
5,358,443 A 10/1994 Mitchell et al.
5,399,119 A 3/1995 Birk et al.
5,429,481 A 7/1995 Liu
5,443,625 A 8/1995 Schaffhausen
5,458,505 A 10/1995 Prager
5,462,484 A 10/1995 Jung et al.
5,511,942 A 4/1996 Meier
5,513,953 A 5/1996 Hansen
5,520,515 A * 5/1996 Bailey et al. ..... 416/208
5,547,343 A 8/1996 Jané et al.
5,561,952 A 10/1996 Damron
5,569,019 A 10/1996 Katariya et al.
5,584,656 A 12/1996 Rose
5,595,068 A 1/1997 Amr
5,613,833 A 3/1997 Wolfe et al.
5,658,196 A 8/1997 Swaim
5,664,872 A 9/1997 Spearman et al.
5,709,458 A 1/1998 Metz
5,725,356 A 3/1998 Carter
5,791,985 A 8/1998 Schiedegger et al.
5,918,972 A 7/1999 Van Belle
5,934,783 A 8/1999 Yoshikawa
5,947,816 A 9/1999 Schiedegger et al.
5,967,891 A 10/1999 Riley et al.
5,997,253 A 12/1999 Fechan
6,004,097 A 12/1999 Wark et al.
6,068,385 A 5/2000 Hsieh
6,095,671 A 8/2000 Hutain
6,109,874 A 8/2000 Steiner
6,145,798 A 11/2000 Janisse et al.
6,149,513 A 11/2000 Lyu
6,155,782 A 12/2000 Hsu
6,168,517 B1 1/2001 Cook
6,183,203 B1 2/2001 Grintz
6,192,702 B1 2/2001 Shimogori
6,196,915 B1 3/2001 Schiedegger et al.
6,352,473 B1 3/2002 Clark
6,360,816 B1 3/2002 Wagner
6,361,428 B1 3/2002 Tosconi et al.
6,361,431 B1 3/2002 Kawano
6,364,760 B1 4/2002 Rooney
6,383,072 B2 5/2002 Schiedegger et al.
6,384,494 B1 5/2002 Avidano et al.
6,386,970 B1 5/2002 Vernier, II et al.
6,386,972 B1 5/2002 Schiedegger et al.
6,435,964 B1 8/2002 Chang
6,458,028 B2 10/2002 Snyder
6,484,524 B1 11/2002 Ulanov
6,551,185 B1 4/2003 Miyake et al.
6,575,011 B1 6/2003 Busby et al.
6,581,974 B1 6/2003 Ragner et al.
6,582,291 B2 6/2003 Clark
6,592,328 B1 7/2003 Cahill
6,595,747 B2 * 7/2003 Bos ..... 415/209.4
6,626,003 B1 9/2003 Kortüm et al.
6,626,636 B2 9/2003 Bohn
6,648,752 B2 11/2003 Vernier, II et al.
6,679,433 B2 1/2004 Gordon et al.
6,682,308 B1 1/2004 Fei et al.
6,767,281 B2 7/2004 McKee
6,783,578 B2 8/2004 Tillman, Jr.
6,804,627 B1 10/2004 Marokhovsky et al.
6,812,849 B1 11/2004 Ancel
6,886,270 B2 5/2005 Gilmer
6,916,240 B1 7/2005 Morton
6,938,631 B2 9/2005 Gridley
6,951,081 B2 10/2005 Bonshor
6,966,830 B2 11/2005 Hurlstone et al.
6,974,381 B1 12/2005 Walker et al.
7,011,578 B1 3/2006 Core
7,044,849 B2 5/2006 Dippel
7,048,499 B2 * 5/2006 Mathson et al. ..... 415/209.3
7,056,092 B2 6/2006 Stahl
7,101,064 B2 9/2006 Ancel
7,166,023 B2 1/2007 Haigh et al.
7,175,309 B2 2/2007 Craw et al.
7,185,504 B2 3/2007 Kasai et al.
7,201,110 B1 4/2007 Pawlak
7,201,650 B2 4/2007 Demerath et al.
7,214,035 B2 5/2007 Bussieres et al.
7,288,023 B2 10/2007 Leopold

(56) References Cited

U.S. PATENT DOCUMENTS

| | | | | |
|---|---|---|---|---|
| 7,320,636 | B2 | 1/2008 | Seliger et al. | |
| 7,374,408 | B2 | 5/2008 | Savage et al. | |
| 7,381,129 | B2 | 6/2008 | Avedon | |
| 7,467,931 | B2 | 12/2008 | O'Toole | |
| 7,497,773 | B1 | 3/2009 | Schmidt | |
| 7,516,578 | B2 | 4/2009 | Bonshor | |
| 7,544,124 | B2 | 6/2009 | Polston | |
| 7,549,258 | B2 | 6/2009 | Lajewski | |
| 7,566,034 | B2 | 7/2009 | Bonshor | |
| 7,607,935 | B2 | 10/2009 | Dahl | |
| 7,610,726 | B2 | 11/2009 | Lajewski | |
| 7,645,188 | B1 | 1/2010 | Peerbolt | |
| 7,651,390 | B1 | 1/2010 | Profeta et al. | |
| 7,677,964 | B1 | 3/2010 | Bucher et al. | |
| 7,708,625 | B2 | 5/2010 | Leseman et al. | |
| 7,752,814 | B2 | 7/2010 | Bonshor | |
| 7,774,999 | B2 | 8/2010 | McKee | |
| 7,780,510 | B2 | 8/2010 | Polston | |
| 7,901,278 | B2 | 3/2011 | O'Hagin | |
| 7,930,858 | B2 | 4/2011 | Lajewski | |
| 2002/0045420 | A1 | 4/2002 | Taillon | |
| 2002/0137454 | A1 | 9/2002 | Baker | |
| 2004/0050077 | A1 | 3/2004 | Kasai et al. | |
| 2004/0052641 | A1* | 3/2004 | Chen | 416/220 A |
| 2004/0240214 | A1 | 12/2004 | Whitlow et al. | |
| 2005/0092888 | A1 | 5/2005 | Gonce | |
| 2005/0159101 | A1 | 7/2005 | Hrdina et al. | |
| 2005/0202776 | A1 | 9/2005 | Avedon | |
| 2006/0276123 | A1 | 12/2006 | Sanagi et al. | |
| 2007/0213003 | A1 | 9/2007 | Railkar et al. | |
| 2007/0297906 | A1 | 12/2007 | Wu | |
| 2008/0188175 | A1 | 8/2008 | Wilkins | |
| 2008/0227381 | A1 | 9/2008 | Avedon | |
| 2009/0170421 | A1 | 7/2009 | Adrian et al. | |
| 2009/0262550 | A1 | 10/2009 | Inoue | |
| 2010/0009621 | A1 | 1/2010 | Hsieh | |
| 2010/0052495 | A1 | 3/2010 | Liu et al. | |
| 2010/0176706 | A1 | 7/2010 | Fu et al. | |
| 2010/0192611 | A1 | 8/2010 | Yamaguchi et al. | |
| 2011/0037368 | A1 | 2/2011 | Huang | |
| 2011/0057551 | A1 | 3/2011 | Lee et al. | |
| 2011/0057552 | A1 | 3/2011 | Weaver | |
| 2011/0080096 | A1 | 4/2011 | Dudik et al. | |
| 2011/0084586 | A1 | 4/2011 | Lain et al. | |
| 2011/0133622 | A1 | 6/2011 | Mo et al. | |
| 2011/0140588 | A1 | 6/2011 | Chen | |
| 2012/0195749 | A1 | 8/2012 | Avedon | |

FOREIGN PATENT DOCUMENTS

| | | | |
|---|---|---|---|
| DE | 10 2008 044874 | | 3/2010 |
| EP | 0 037 958 | | 10/1981 |
| EP | 0 212 749 | | 3/1987 |
| EP | 2 248 692 | | 11/2010 |
| FR | 0 715 101 | | 11/1931 |
| FR | 2784423 | | 4/2000 |
| GB | 981188 | | 1/1965 |
| GB | 2344619 | | 6/2000 |
| GB | 2 468 504 | | 9/2010 |
| JP | 55-32965 | | 3/1980 |
| JP | 61-502267 | | 10/1986 |
| JP | 07-167097 | | 7/1995 |
| JP | 07-253231 | | 10/1995 |
| JP | 2001-193979 | | 7/2001 |
| JP | 2002-349489 | | 12/2002 |
| JP | 2006-350237 | | 12/2006 |
| KR | 2003-0025428 | | 3/2003 |
| RU | 2400254 | C2 | 9/2010 |
| WO | WO 01/34983 | | 5/2001 |
| WO | WO 2006/078102 | | 7/2006 |
| WO | WO 2008/062319 | | 5/2008 |
| WO | WO 2010/046536 | A1 | 4/2010 |
| WO | WO 2011/067430 | | 6/2011 |

OTHER PUBLICATIONS

Translation of Office Action for Japanese application No. 2007-503918, in two pages, letter dated May 18, 2011.

International Search Report for Application No. PCT/US2012/042308 mailed Aug. 24, 2012 in 13 pages.

European Office Action for application No. 05714125.1, dated Mar. 11, 2010, in 7 pages.

Examination Report for New Zealand's Application No. 549851, dated Mar. 10, 2009, in 3 pages.

Examiner's First Report for Australian Application No. 2005227197, dated Nov. 23, 2009, in 3 pages.

Official Communication in Australian Application No. 2011253799, dated Sep. 17, 2012, in 4 pages.

Official Communication in Canadian Application No. 2,559,610, dated Aug. 26, 2011 in 3 pages.

Official Communication in European Application No. 05714125.1, dated Jul. 4, 2012, in 5 pages.

European Search Report for Application No. EP 12160654.5, dated Aug. 24, 2012 in 6 pages.

Official Communication in Korean Application No. 10-2006-7021292, dated Mar. 16, 2012, in 12 pages.

Official Communication in New Zealand Application No. 549851, dated Sep. 22, 2010, in 2 pages.

Official Communication in Polish Application No. P-382705, dated Nov. 10, 2011, in 1 page.

International Search Report and Written Opinion in International Application No. PCT/US2012/042309, dated Oct. 24, 2012 in 12 pages.

Examiner's Second Report for Australian Application No. 2005227197, dated Dec. 20, 2010, in 2 pages.

Japanese Office Action dated Oct. 26, 2010 for Japanese Application No. 2007-503918, in 3 pages.

European Search Report for Application No. EP 05714125.1, dated Apr. 20, 2009 in 5 pages.

International Search Report for International Application No. PCT/US2010/027546, dated May 12, 2010 in 2 pages.

Written Opinion of the International Searching Authority for International Application No. PCT/US2010/027546, dated May 12, 2010 in 5 pages.

* cited by examiner

COLUMNAR AIR MOVING DEVICES, SYSTEMS AND METHOD

CROSS-REFERENCE TO RELATED APPLICATIONS

This application claims benefit under 35 U.S.C. §119(e) to U.S. Provisional Patent Application No. 61/164,808, filed Mar. 30, 2009, and to U.S. Provisional Patent Application No. 61/222,439, filed Jul. 1, 2009, each of which is incorporated in its entirety by reference herein.

BACKGROUND OF THE INVENTIONS

1. Field of the Inventions

The present application relates to heating, ventilating and air conditioning air spaces, and more particularly to systems, devices and methods for moving air in a columnar pattern with minimal lateral dispersion that are particularly suitable for penetrating air spaces and air temperature de-stratification.

2. Description of the Related Art

The rise of warmer air and the sinking of colder air creates significant variation in air temperatures between the ceiling and floor of buildings with conventional heating, ventilation and air conditioning systems. Such air temperature stratification is particularly problematic in large spaces with high ceilings such as warehouses, gymnasiums, offices, auditoriums, hangers, commercial buildings, and even residences with cathedral ceilings, and can significantly increase heating and air conditioning costs. Further, both low and high ceiling rooms can have stagnant or dead air. For standard ceiling heights with duct outlets in the ceiling there is a sharp rise in ceiling temperatures when the heat comes on.

One proposed solution to air temperature stratification is a ceiling fan. Ceiling fans are relatively large rotary fans, with a plurality of blades, mounted near the ceiling. The blades of a ceiling fan have a flat or airfoil shape. The blades have a lift component that pushes air upwards or downwards, depending on the direction of rotation, and a drag component that pushes the air tangentially. The drag component causes tangential or centrifugal flow so that the air being pushed diverges or spreads out. Conventional ceiling fans are generally ineffective as an air de-stratification device in relatively high ceiling rooms because the air pushed by conventional ceiling fans is not maintained in a columnar pattern from the ceiling to the floor, and often disperses or diffuses well above the floor.

Another proposed solution to air temperature stratification is a fan connected to a vertical tube that extends substantially from the ceiling to the floor. The fan may be mounted near the ceiling, near the floor or in between. This type of device may push cooler air up from the floor to the ceiling or warmer air down from the ceiling to the floor. Such devices, when located away from the walls in an open space in a building, interfere with floorspace use and are not aesthetically pleasing. When confined to locations only along the walls of an open space, such devices may not effectively circulate air near the center of the open space. Examples of fans connected to vertical tubes are disclosed in U.S. Pat. No. 3,827,342 to Hughes, and U.S. Pat. No. 3,973,479 to Whiteley.

A device that provides a column of air that has little or no diffusion from the ceiling the floor, without a vertical tube, can effectively provide air de-stratification. U.S. Pat. Nos. 4,473,000 and 4,662,912 to Perkins disclose a device having a housing, with a rotating impeller having blades in the top of the housing and a plurality of interspersed small and large, vertically extending, radial stationary vanes spaced below the impeller having blades in the housing. The device disclosed by Perkins is intended to direct the air in a more clearly defined pattern and reduce dispersion. Perkins, however, does not disclose the importance of a specific, relatively small gap between the impeller blades and the stationary vanes, and the device illustrated creates a vortex and turbulence due to a large gap and centrifugal air flow bouncing off the inner walls of the housing between the blades and vanes. Perkins also discloses a tapering vane section. The tapering vane section increases velocity of the exiting air stream.

A device with a rotary fan that minimizes the rotary component of the air flow while maximizing the axial air flow quantity and velocity can provide a column of air that flows from a high ceiling to a floor in a columnar pattern with minimal lateral dispersion that does not require a physical transporting tube. Such a device can reduce the energy loss by minimizing the rotary component of the air flow, and therefore minimizes turbulence. Such a device can minimize back pressure, since a pressure drop at the outlet of the device will cause expansion, velocity loss and lateral dispersion. The device can have minimum noise and low electric power requirements.

SUMMARY OF THE INVENTION

An aspect of at least one of the embodiments disclosed herein includes the realization that columnar air moving devices, or portions of them, can often be bulky and difficult to mold. Such bulky portions inhibit easy modification, removal, and/or adjustment of the columnar air moving device, and can require expensive molding techniques and processes. It would be advantageous to have a columnar air moving device with removable, interchangeable components. In particular, it would be advantageous to have a stator vane section of a columnar air moving device with removable, interchangeable components.

Thus, in accordance with at least one embodiment described herein, a columnar air moving device can comprise a plurality of separate, attachable components which can be assembled and disassembled. The columnar air moving device can comprise modular stator vanes, which direct air in an axial direction away from the device, and which are arranged in a radial pattern within the device. The modular stator vanes can quickly be replaced, removed, and/or adjusted to create various configurations, and can be formed with injection-molding processes.

According to another embodiment, a vane assembly comprises a top member having a cup-like shape and a bottom member having a cup-like shape. A plurality of vane members; each vane member having a top edge, a bottom edge, an outer lateral edge, an inner lateral edge, and an elongated flange extending along the inner lateral edge, the elongated flange having a top end and a bottom end. The plurality of vane members are arranged in a circular pattern around a longitudinally extending axis such that the vane members point in a generally radial direction away from the longitudinal axis with the top ends of the elongated flanges being positioned within the top member and the bottom ends of elongated flanges being positioned within the bottom member.

According to another embodiment, an air moving device comprises a housing having an air inlet at a first end and an air outlet at a second end spaced from the first end with an air flow passage between the first and second end. A rotary fan is mounted in the housing near the air inlet and having an impeller with a diameter and a plurality of blades that produce an air flow with rotary and axial air flow components. A modular stator vane assembly is mounted in the housing. The stator vane assembly comprises a top member, bottom member, and a plurality of modular stator vanes between the top and bottom members and extending between the impeller and air outlet for converting the rotary component of the airflow into laminar and axial air flow in the housing. The air flow exits the air outlet in an axial stream extending beyond the air outlet in a columnar pattern with minimal lateral dispersion.

According to another embodiment, a method of assembling an air moving device comprises assembling a plurality of modular stator vanes within a top and bottom member. Each modular stator vane has a top edge, a bottom edge, an outer lateral edge, an inner lateral edge, and an elongated flange extending along the inner lateral edge, the elongated flange having a top end and a bottom end. A plurality of modular stator vanes are arranged in a circular pattern around a longitudinally extending axis such that the modular stator vanes point in a generally radial direction away from the longitudinal axis with the top ends of the elongated flanges being positioned within the top member and the bottom ends of elongated flanges being positioned within the bottom member. The module stator vanes are mounted within a housing of the air moving device. A rotary fan is mounted in the housing above the modular stator vanes and top and bottom members, and near an air inlet of the housing, the rotary fan having an impeller with a diameter and a plurality of blades that produce an air flow with rotary and axial air flow components. In some embodiments, the plurality of modular stator vanes are arranged in a circular pattern at least partially within the top and bottom members.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENTS

Figure 1:
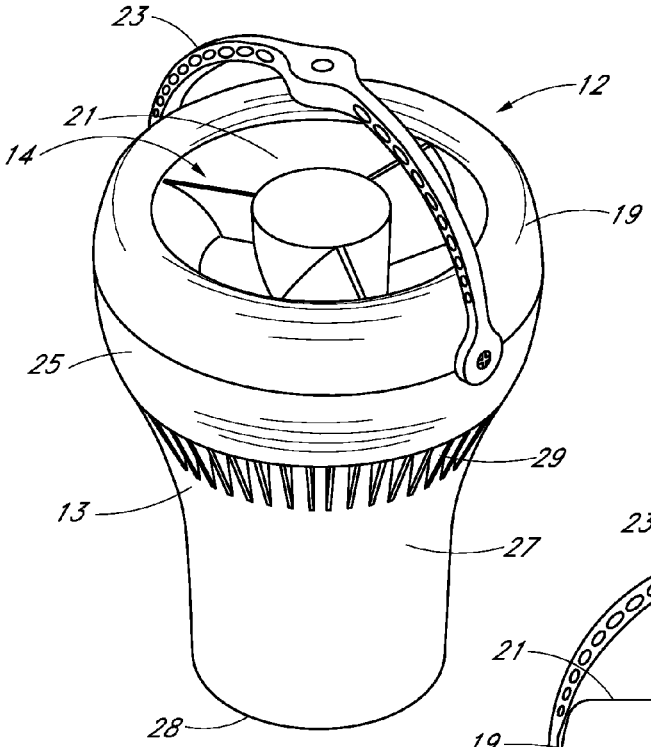
FIG. 1 is a top perspective view of an air moving device embodying features of the present invention.
Figure 2:
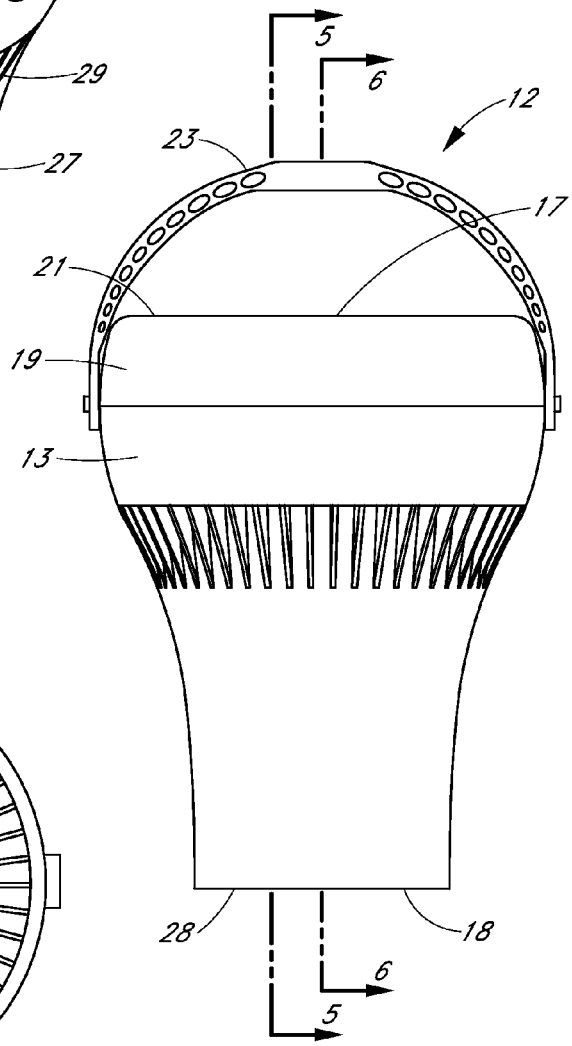
FIG. 2 is a side elevation view of the device of FIG. 1.
Figure 3:
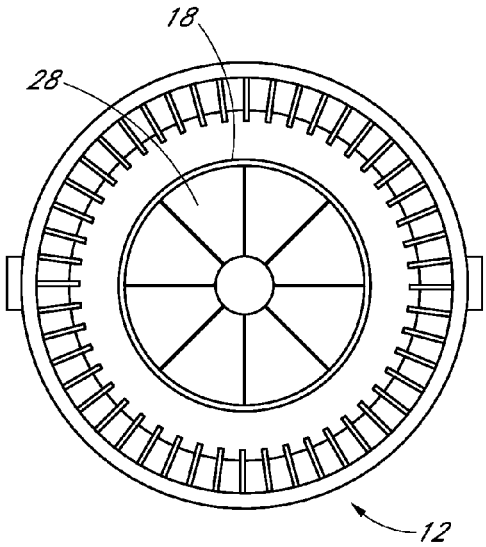
FIG. 3 is a bottom view of the device of FIG. 1.

With reference to FIGS. 1-6, there is shown one illustrated embodiment of an air moving device 12 having an elongated outer housing 13. The air moving device 12 can include an electric rotary fan 14 in the housing for producing air flow in the housing, and a stator vane assembly 16 for directing the airflow in the device 12.

With continued reference to FIGS. 1-6, the housing 13 can have a circular cross section, an open first end 17 and an open second end 18 spaced from to first end 17. In the illustrated embodiment, a detachable, axially outwardly convex cowling 19 forms the first end 17 and provides an air inlet 21 with a diameter slightly smaller than the outer diameter of the cowling 19.

Figure 4A:
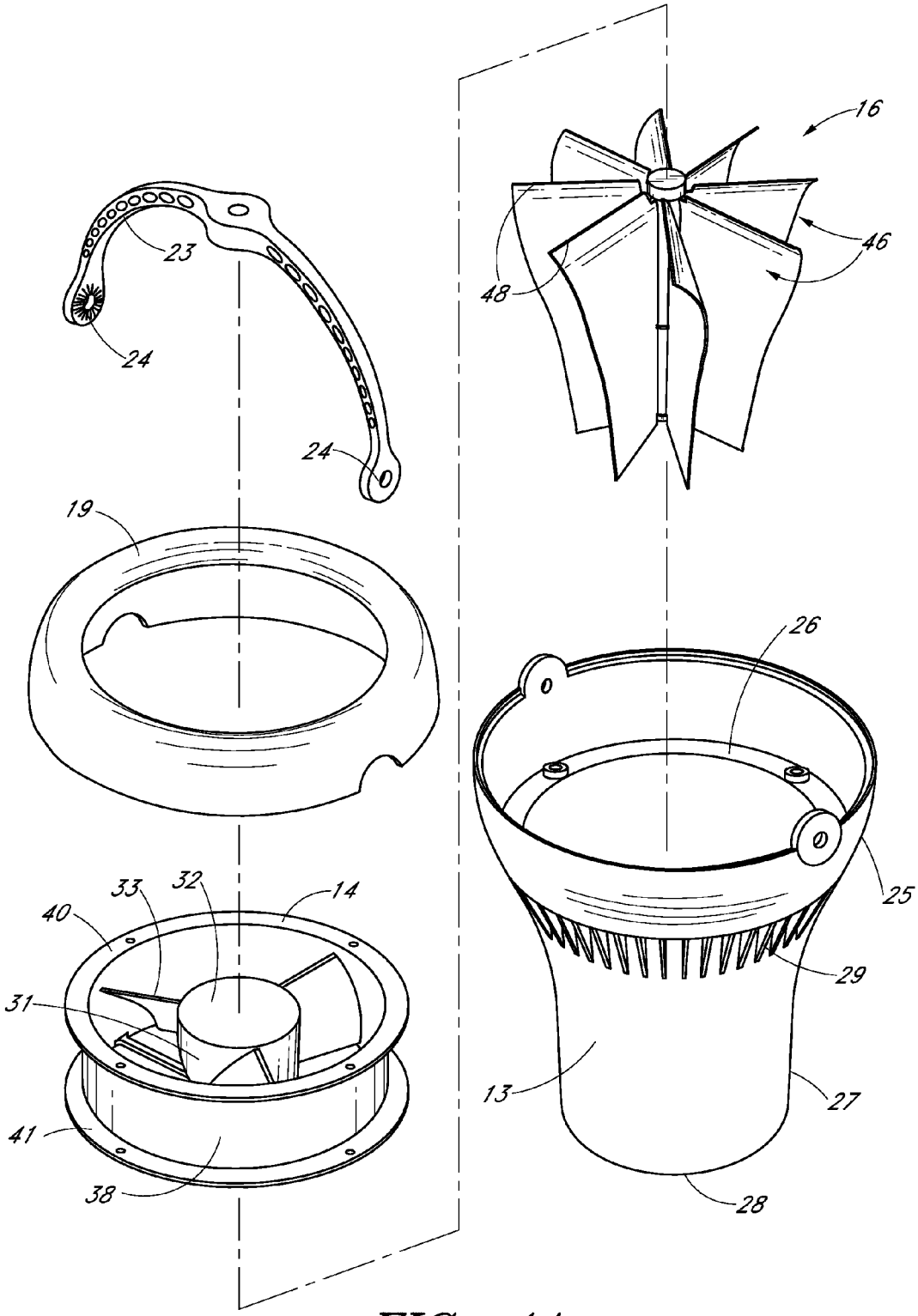
FIG. 4A is an exploded perspective view of the device of FIG. 1.

As shown in FIG. 4A, the housing 13 can have a first section 25 extending from the cowling 19 to an interior shelf 26. In the illustrated arrangement, a generally C shaped hanger 23 mounts at opposite ends 24 to opposite sides of the housing 13 at the upper end of the first section 25, for mounting the air moving device 12 to a support. The first section 25, when viewed from the side, can have a curved, slightly radially outwardly convex shape that conforms to the curvature of the cowling 19. The shelf 26 can extend radially inwardly to join with the upstream end of a second section 27. The second section 27 tapers inwardly and extends axially from the shelf 26 to the second end 18 along a smooth curve that goes from radially outwardly convex near the shelf 26 to radially outwardly concave near the second end 18. The second end 18 forms an air outlet 28 that has a smaller diameter than the air inlet 21. A plurality of circumferentially spaced external fins 29 can extend from the shelf 26 to the second section 27 to provide the appearance of a smooth curve from the air inlet 21 to the air outlet 28 when the housing 13 is viewed from the side.

Figure 4B:
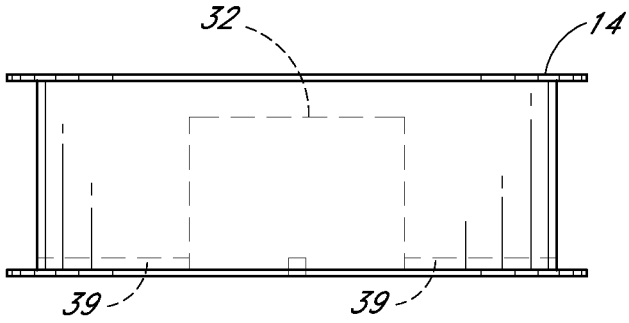
FIG. 4B is a side plan view of a fan component of the device of FIG. 1.
Figure 4C:
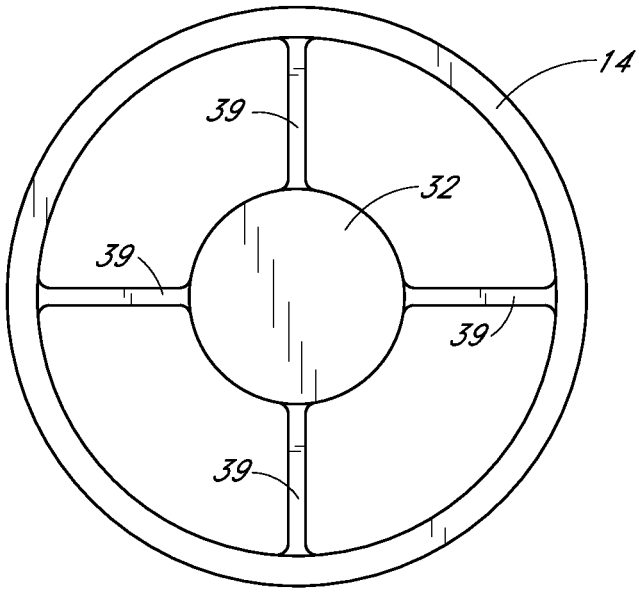
FIG. 4C is a top plan view of the fan component of FIG. 4B.
Figure 5:
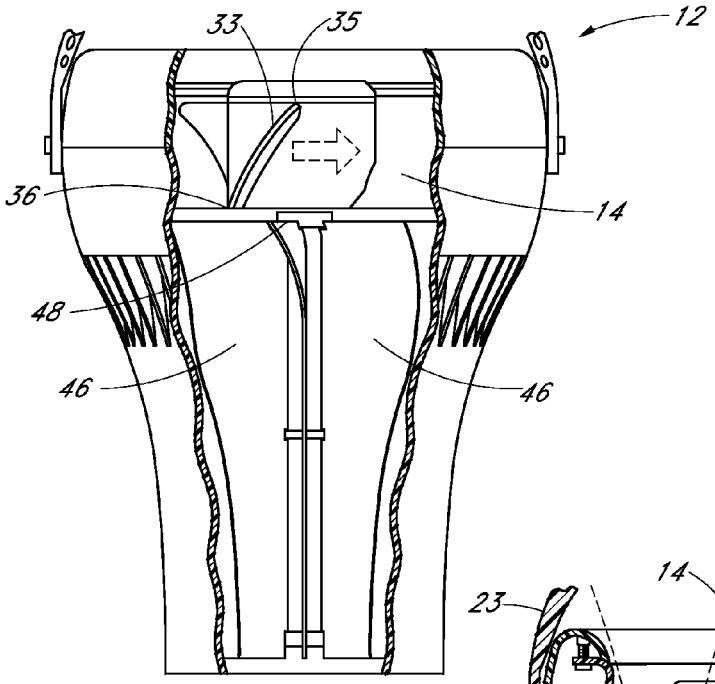
FIG. 5 is a sectional view taken along line 5-5 of FIG. 2.

With continued reference to FIGS. 4A-C, the fan 14 can include an impeller 31 having a cylindrical, inner impeller hub 32, with an electric motor 34 therein, and a plurality of rigidly mounted, circumferentially spaced blades 33 extending radially from the impeller hub 32. In the illustrated embodiment the impeller 31 has three equally spaced blades 33 and rotates about an axis in a counter-clockwise direction when viewed from above. With reference to FIG. 5, each blade 33, in side view, can extend from an upstream edge 35, downwardly and leftwardly to a downstream edge 36 with each blade 33 being slightly concave, in an airfoil or wing shape, downwardly to propel air rightwardly as shown by the arrow. In yet other embodiments, one or more of the blades 33 can have a straight, as opposed to concave, configuration. Each blade 33 can be inclined at a selected angle to the axis of rotation of the impeller. In the illustrated embodiment, each blade 33 shown extends axially and radially toward the outlet or second end 18 to direct air axially with a rotary component. If the motor 34 runs in the opposite direction, the incline of the blades 33 would be reversed. The fan 14 can include a stationary cylindrical housing 38 that extends around the blades 33, and a support 39, with the impeller hub 32 being rotatably mounted relative to the support 39. The blades 33 can extend radially from the hub 32, without contacting the cylindrical housing 38. The cylindrical housing 38 has spaced, protruding upstream and downstream mounting rims 40 and 41. As illustrated in FIG. 4A, the fan 14 can be mounted in the housing 13 between the cowling 19 and the shelf 26.

Figure 6:
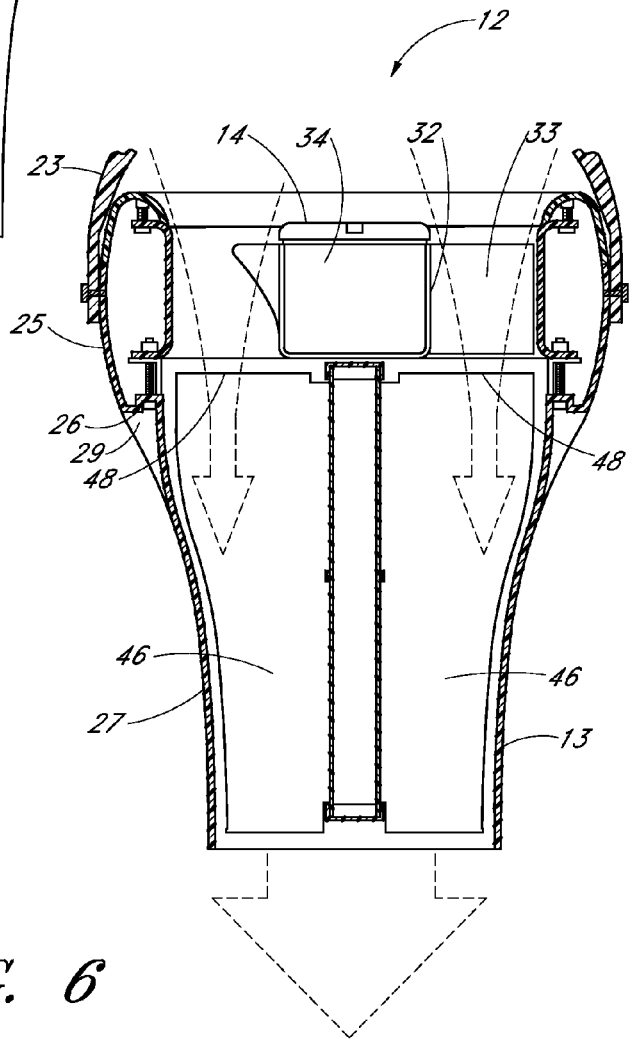
FIG. 6 is a sectional view taken along line 6-6 of FIG. 2.

The stator assembly 16 can nest in and be separable from the housing 13. In some embodiments, the stator assembly 16 can be attached to the shelf 26, or can rest below the shelf 26. With reference to FIG. 6, the attachment or placement of the stator assembly 16 can leave a gap having a selected size between the downstream edge 36 of the blades 33 of the impeller 31 and the upstream ends 48 of the stator vanes 46. If the gap is too large, turbulence can be generated in the air flow between the blades 33 and the vanes 46, reducing the velocity of the air flow. If the gap is too small, fluid shear stress can generate noise. The size of the gap can generally be selected as no greater than a maximum selected dimension to avoid turbulence and no less than a selected minimum dimension to avoid noise, and more particularly selected as small as possible without generating noise.

The selected size of the gap can generally be proportional to the size of the blades 33 and can further be affected by the speed of the blades 33. The following are examples: For blades 33 with an outside diameter of 6.00", and radius of 3" (the radius being measured from a central axis of the hub 32 to a radial tip of the blade 33), at 1800 rpm, the maximum size of the gap can be 1.25" and the minimum gap can be 0.2". For blades 33 with a diameter of 8.5", at 1400 rpm, the maximum size of the gap can be 1.25", and the minimum gap can be 0.2" but could be 0.020 for lower rpm's as the size of the gap is rpm dependent. Generally, the maximum size of the gap can be less than one half the diameter of the blades 33.

With reference to FIG. 4A, in the illustrated embodiment, eight equally spaced stator vanes 46 are provided, and when viewed from the side, the stator vanes extend straight upwardly from the downstream ends and then curve leftwardly near the upstream ends 48. The upstream end of each curved vane is inclined at an angle opposite the incline of the blade 33 that extends axially and radially inward toward the outlet or second end 28 to assist in converting the rotary component of the air flow into laminar and axial flow in the housing. Straight upstream ends of the stator vanes can also be used, as can other numbers of stator vanes.

The air moving device 12 can discharge air at a high velocity in a generally axial flow having a columnar pattern with minimal lateral dispersion after exiting the air outlet 28. The cowling 19 extends along a curve toward the inside to reduce turbulence and noise for air flow entering the air inlet 21.

The stator vanes 46 convert the rotary component of the air flow from the blades 33 into laminar and axial air flow in the housing. The leftward curve of the upstream ends 48 of the stator vanes, in the illustrated embodiment, reduces the energy loss in the conversion of the rotary component of the air flow from the blades 33 into laminar and axial air flow in the housing. The small gap between the blades 33 and stator vanes 46 can prevent the generation of turbulence in the air flow in the gap.

Figure 7:
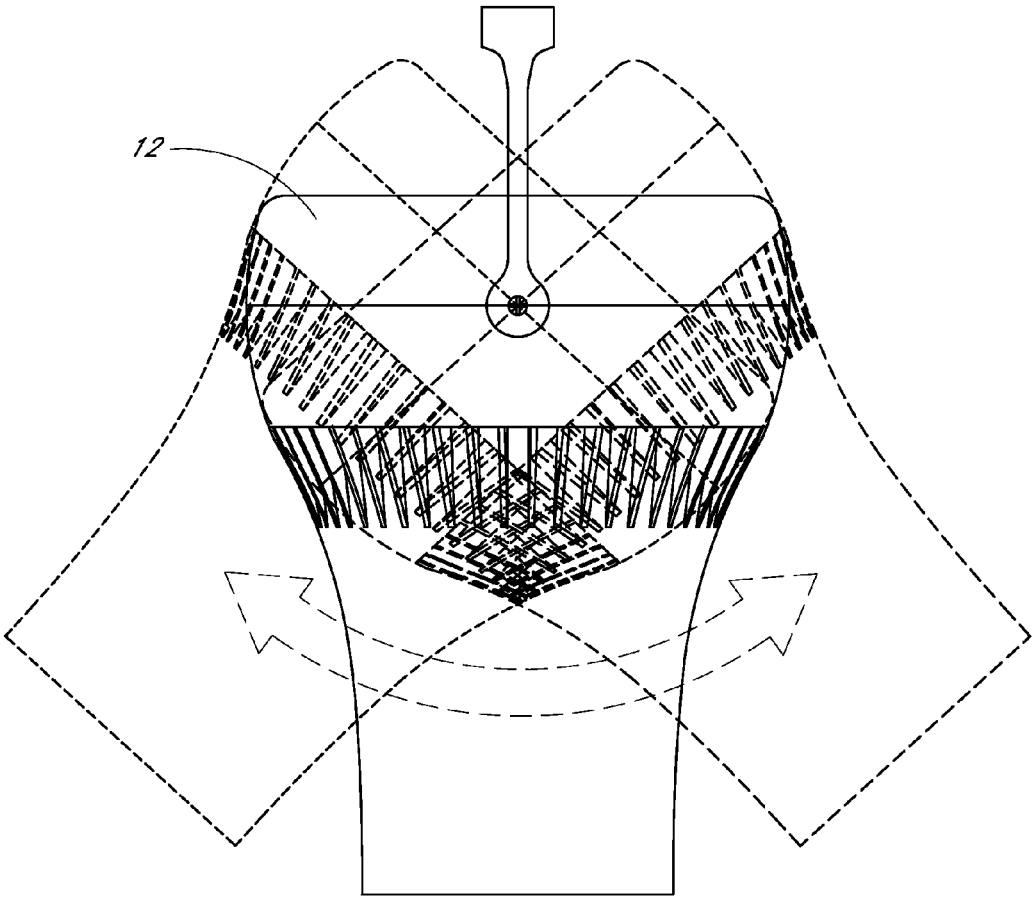
FIG. 7 is a side elevation view of the device of FIG. 1 showing angular direction of the device.
Figure 8:
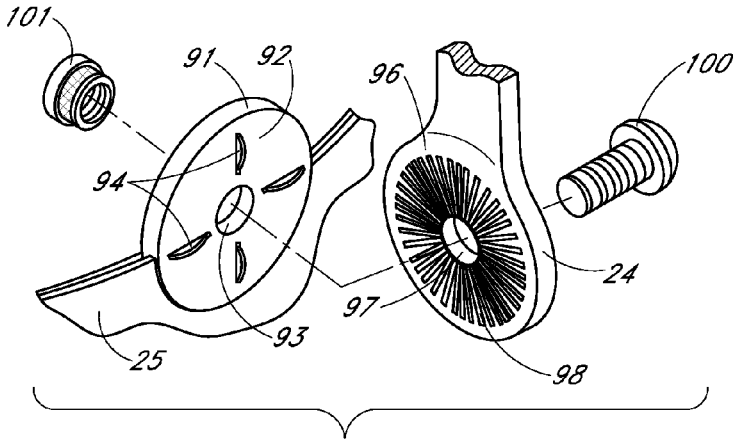
FIG. 8 is an enlarged, partial exploded view of a hangar attachment of the device of FIG. 1.

With reference to FIGS. 4A, 7, and 8, the hanger 23 can be mounted to rotate and lock relative to the housing 13, so that when the hanger 23 is attached to an overhead support such as ceiling, the air flow from the air moving device 12 can be directed vertically or aimed at any selected angle from the vertical as shown in FIG. 7. As shown in FIGS. 1 and 8, the first section 25 of the housing 13 can include mounting tabs 91 on opposite sides on the upper edge of the first section 25. Each mounting tab 91 includes a round, outwardly directed mounting face 92, and a housing aperture 93 that extends inwardly through the center of the mounting tab 91. A pair of outwardly projecting housing ridges 94 extend radially on the mounting face 92 on opposite sides of the housing aperture 93.

Each end 24 of the hanger 23 can have a round, inwardly facing hanger end face 96, similar in size to the mounting face 92 on the housing 13. A hanger end aperture 97 extends through the center of the hanger end face 96. A plurality of spaced, radially extending grooves 98, sized to receive the housing ridges 94, can be provided on each hanger end face 96. Bolt 100 extends through the hanger end aperture 97 and threads into an internally threaded cylindrical insert 101, rigidly affixed in housing aperture 93. The angle of the housing 13 can be chosen by selecting a pair of opposed grooves 98 on each hanger end 24 to receive the housing ridges 94. The pivotal arrangement enables the housing to move to a selected angle and is lockable at the selected angle to direct air flow at the selected angle.

Figure 9:
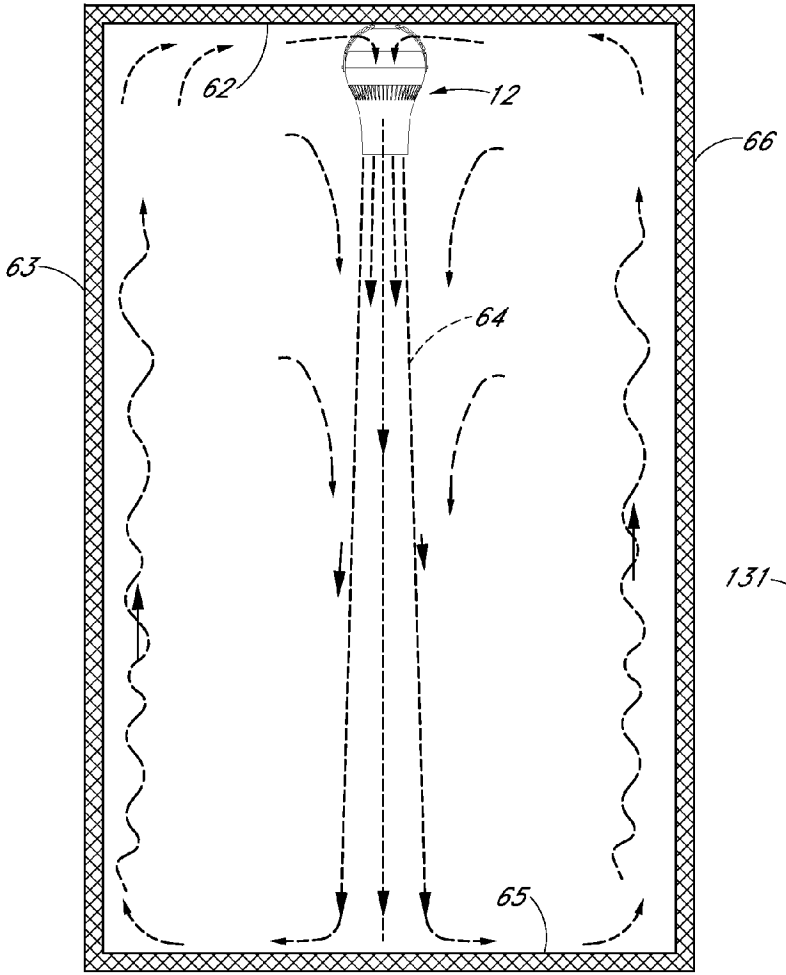
FIG. 9 is a side view of a room with the device of FIG. 1 showing an air flow pattern with dashed lines and arrows.

FIG. 9 shows an air moving device 12 mounted to the ceiling 62 of a room 63 shown as being closed sided with opposed side walls. Warm air near the ceiling 62 is pulled into the air moving device 12. The warm air exits the air moving device 12 in a column 64 that extends to the floor 65. When the column 64 reaches the floor 65, the warm air from the ceiling pushes the colder air at the floor 65 outward towards the opposed side walls 66 and upward towards the ceiling 62. When the column 64 reaches the floor 65, the warm air from the ceiling will also transfer heat into the floor 65, so that heat is stored in the floor 65. The stored heat is released when the ceiling is cooler than the floor. The heat may also be stored in articles on the floor and earth under the floor. The air moving device 12 can destratify the air in a room 63 without requiring the imperforate physical tube of many prior known devices. The air moving device 12 destratifies the air in a room 63 with the warmer air from the ceiling 62 minimally dispersing before reaching the floor 65, unlike many other prior known devices. The air moving device 12 can also remove dead air anywhere in the room. It is understood that the air moving device 12 may also be mounted horizontally in a container, trailer truck or room as is describe hereafter.

Figure 10:
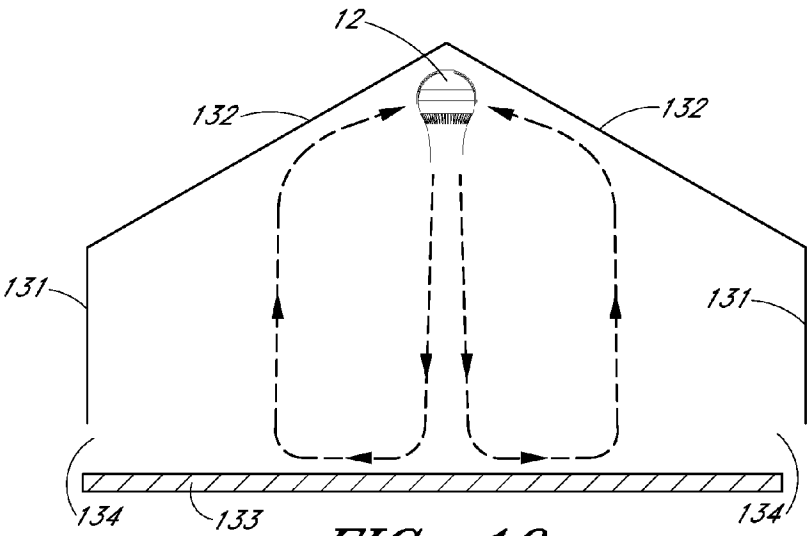
FIG. 10 is a schematic view of an open sided tent with an air moving device in the top.

With reference to FIG. 10, there is shown a tent having an inclined top 132 extending down from an apex and connected at the lower end to a vertical side wall 131 and terminating above a floor 133 to provide a side opening 134 so that the tent is an open sided room. The air moving device 12 is mounted below the top apex and directs the air in the room downwardly in a columnar pattern to the floor and along the floor and then back with some air passing in and out the side openings 134 along the floor 133. For wide tents, the air will pass up before it reaches the side walls.

The air moving device and system herein described can have relatively low electrical power requirement. A typical fan motor is 35 watts at 1600 rpm for a blade diameter of 8.5" that will effectively move the air from the ceiling to the floor in a room having a ceiling height of 30 ft. Another example is 75 watts with a blade diameter of 8.5" at 2300 rpm in a room having a ceiling height of 70 ft.

With reference to FIGS. 11-17, the stator vane assembly 16 will now be described in additional detail. As will be described below, the stator vane assembly 16 of the illustrated embodiment can be advantageously formed of vane sub-components 46, which can be assembled together to form the stator vane assembly 16. Preferably, each of the vane subcomponents can be formed from injection molding. This is particularly advantageous for large sizes of air moving devices in which it may be difficult or cost prohibitive to injection mold a stator vane assembly 16 in one or just a few pieces. In addition, as explained below, the illustrated arrangement also advantageously facilitates efficient assembly with a limited number of parts.

Figure 11:
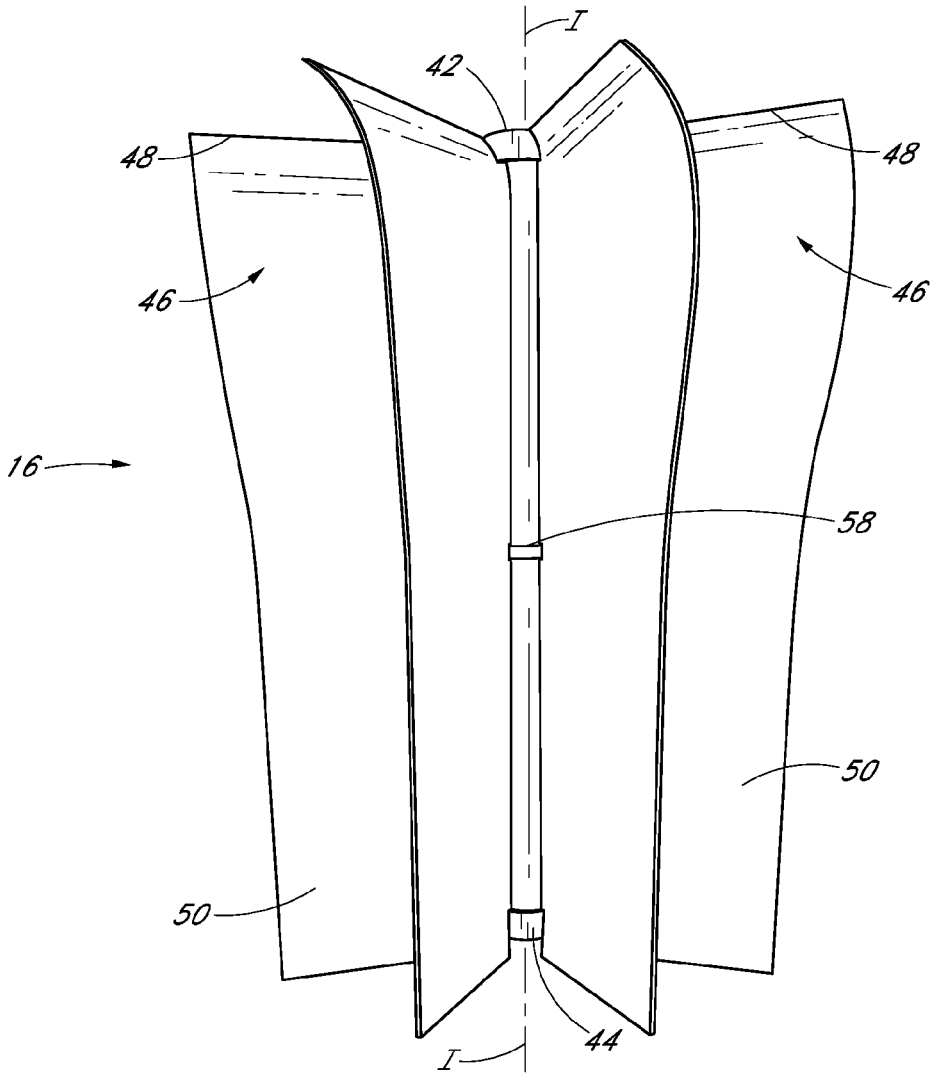
FIG. 11 is a front side perspective view of an embodiment of a stator vane device for us in the air moving device of FIG. 1.
Figure 12:
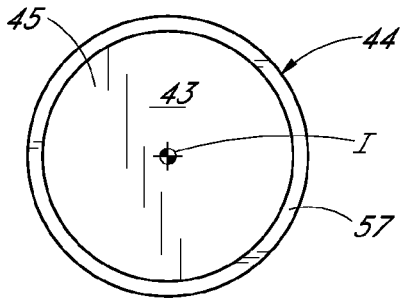
FIG. 12 is a top plan view of a circular bottom plate of the stator vane device of FIG. 11.
Figure 13:
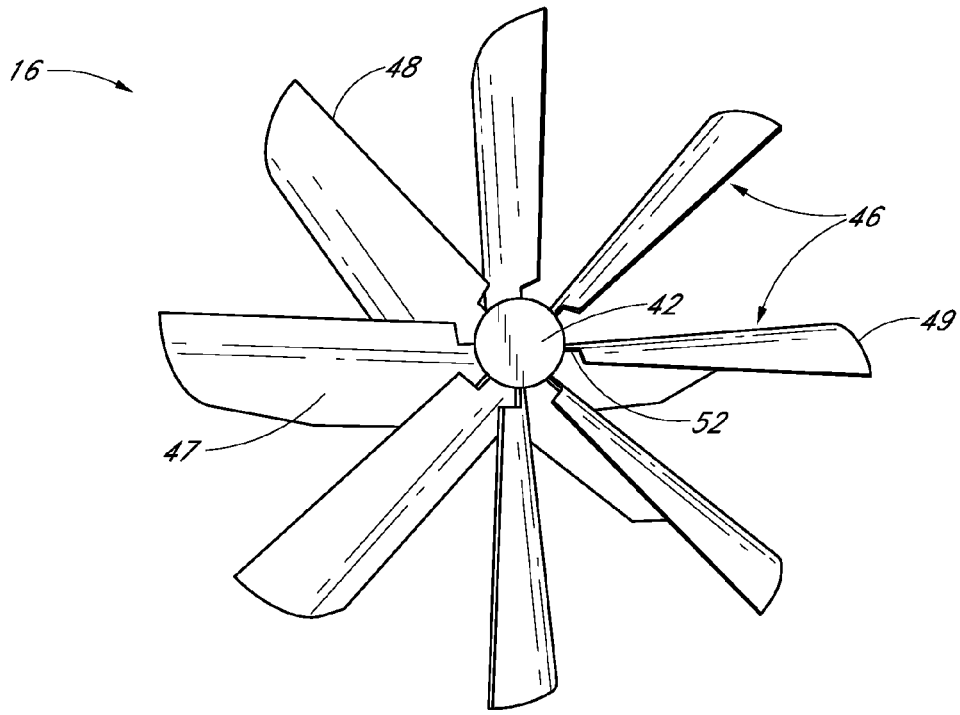
FIG. 13 is a top perspective view the stator vane device of FIG. 11

With initial reference to FIGS. 11-13, the stator vane assembly 16 can comprise a top plate 42, a bottom plate 44, and a plurality of individual modular stator vanes 46 assembled radially about a central axis I extending between the top and bottom plates 42 and 44. The fully assembled stator vane assembly 16 can be used, for example, inside of the device 12 described above, to direct a column of air from an elevated position such as a ceiling, to a lower position such as a floor. The stator vane assembly 16 can be assembled and disassembled quickly and easily (as explained below) and depending on the air movement conditions needed, can include varying numbers and arrangements of individual stator vanes 46.

Figure 14:
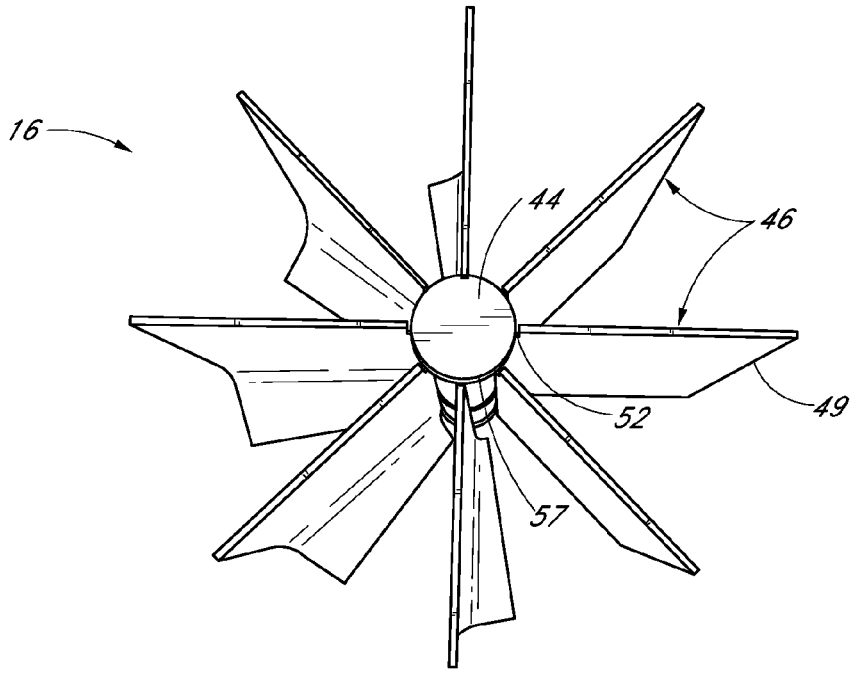
FIG. 14 is a bottom perspective view of the stator vane device of FIG. 11.

With reference to FIGS. 12 and 14, the bottom plate 44 can comprise a circular, cup-like piece of material having a flat circular bottom portion 45 and a circumferential wall 57 extending from the bottom portion, forming a hollowed out cylindrical volume, or "cup 43." The bottom plate 44 can be molded out of plastic, including but not limited to ABS, polypropylene, or other suitable material. As will be explained below, the bottom plate 44 can be used to hold ends of the modular stator vanes 46 in place when the stator vane assembly 16 is fully assembled.

In at least some embodiments, the top plate 42 can have the same, or similar, configuration and shape as that of the bottom plate 44 and, thus, can also comprise a flat circular bottom portion 45 and a circumferential wall 57 that form a cup 43. As will be noted below, on some embodiments, the top plate 42 and bottom plate 44 can be used together to hold ends of stator vanes 46 in place when the stator vane assembly 16 is fully assembled.

Figure 15:
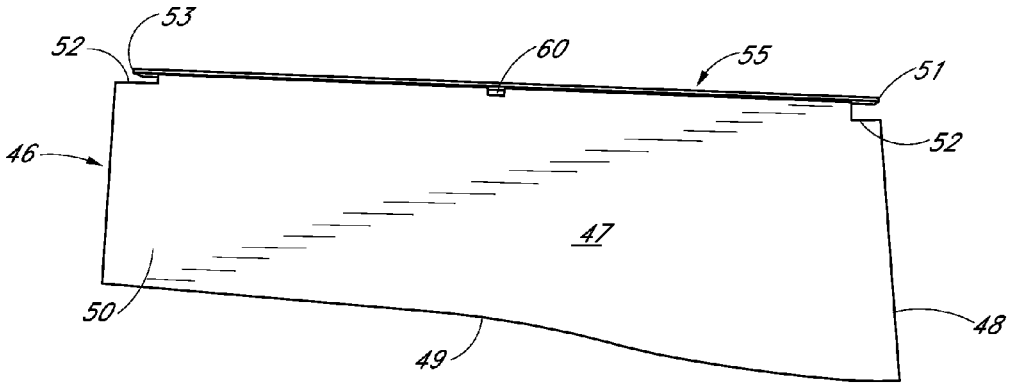
FIG. 15 is a side perspective view of one of the stator vanes of the stator vane device of FIG. 11.

With reference to FIGS. 11 and 15, the modular stator vanes 46 can generally comprise an elongated piece or body 47 of thin plastic material, having a curved profile portion 48 on at least one end. The curved profile portion 48, as described above, can direct incoming air from the blades 33 towards the straight, vertically oriented lower portions 50 of the modular stator vanes 46. With reference to FIG. 11, the curved profile portions 48 and straight portions 50 help direct air. For example, air can be moving both radially and axially as it enters the stator vane assembly 16 near the top plate 42. The combination of the curved profile portions 48 and straight portions 50 can direct the air in an axial direction down towards a floor of a building, inhibiting lateral dispersion of the air after the air leaves the stator vane assembly 16.

With reference to FIGS. 11, 12, and 15, each modular stator vane 46 can also include at least one lip, groove, or other structural feature 52 which is adapted to engage the circumferential wall 57 of the top plate 42 and/or bottom plate 44 to secure at least a portion of the modular stator vane 46 in place within the plates. That is, as seen in FIG. 11, the groove 52 at the upper and lower ends of the vane 46 is configured to receive the circumferential wall 57 of top plate 42 and/or bottom plate 44.

With reference to FIGS. 11-15, the modular stator vanes 46 can be arranged in a radial pattern inside the bottom plate 44 and/or top plate 42 with the groove 52 of each vane 46 engaging the circumferential wall of the top and bottom plates 42, 44. With reference to FIG. 15, in the illustrated embodiment, each modular stator vane 46 can include an annular flange 55 that extends along the longitudinal length of the vane 46 generally opposite an outside edge 49 of the vane 46. The flange 55 can extend generally perpendicular to a plane generally defined by the vane 46. The flange can extend along a curved radius that is similar to the curved radius of the circumferential wall 57 of top plate 42 and/or bottom plate 44. In the illustrated embodiment, when positioned inside the top plate 42 and/or bottom plate 44, a top edge 51 and a bottom edge 53 (see FIG. 15) of the flange advantageously contact the bottom wall 45 of the top plate 42 and/or bottom plate 44 to provide additional structural stability. In this position, the circumferential wall 57 of top plate 42 and/or bottom plate 44 is positioned within the grooves 52 between the flange 55 and the vane body 47.

Figure 16:
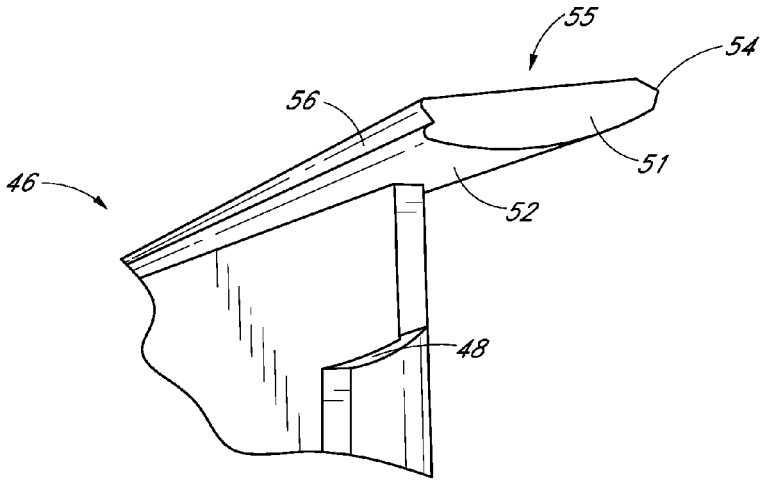
FIG. 16 is a bottom, front, and left side perspective view of the stator vane of FIG. 15.
Figure 17:
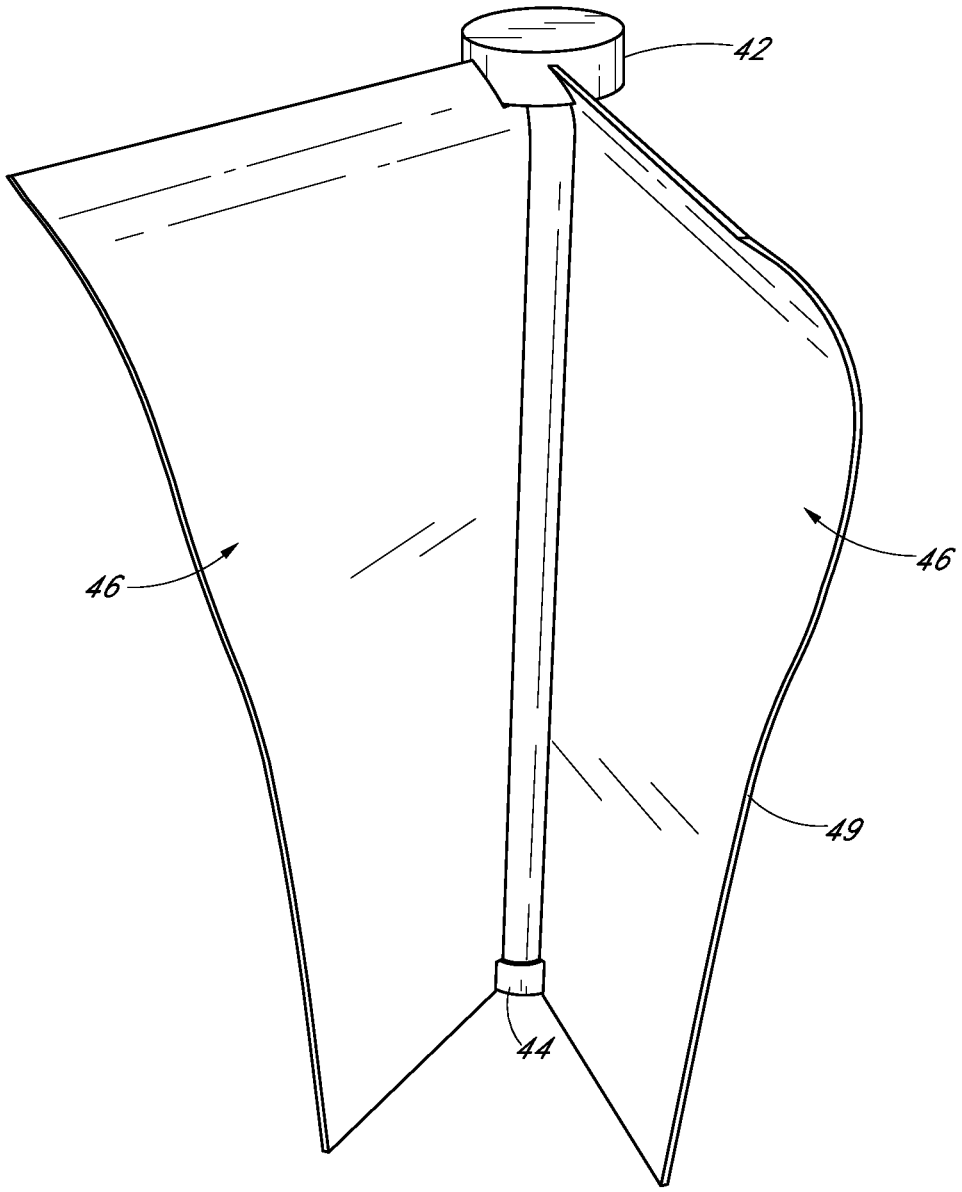
FIG. 17 is a top and front side perspective view of the stator vane device of FIG. 11, showing only two stator vanes attached during assembly of the stator vane device.

As best shown in FIG. 16, a lip 54 and groove 56 can be located along opposing sides of the flange 55 of the modular stator vane 46. During assembly, the lip 54 of one modular stator vane 46 can contact, and/or mate with, a corresponding groove 56 on another modular stator vane 46, such that the two modular stator vanes 46 are linked together at an angle relative to one another. With reference to FIG. 17, which shows a partial assembly of the stator assembly 16, as more modular stator vanes 46 are added on and placed within the bottom plate 44, the linking of the modular stator vanes 46 can begin forming a radial pattern with the ends of the flanges 55 being positioned within the top plate 42 and bottom plate 44. In some embodiments, the flanges 55 can be secured together with adhesives, welds, and/or other bonding techniques and materials.

In at least some embodiments, the modular stator vanes 46 can be arranged in a different pattern from that shown in FIGS. 11, 13, and 14. For example, and as described above, varying numbers of modular stator vanes 46 can be used in the stator assembly 46. While FIGS. 11, 13, and 14 show a total of eight modular stator vanes 46, in other embodiments ten modular stator vanes 46 can be used, while in yet other embodiments four modular stator vanes 46 can be used. Other numbers are also possible, as are other configurations. For example, in some embodiments, it may be advantageous to arrange the modular stator vanes 46 in a different pattern from that shown in FIGS. 11, 13, and 14. In some embodiments, the modular stator vanes 16 can have lips 54 and grooves 56 which can accommodate the desired number and radial orientation of the stator vanes 16 in the stator vane assembly 16.

In other embodiments, the relationship between the top and/or bottom plates 42, 44 and the vanes 46 can be reversed and/or modified. For example, the vanes 46 can be provided with a protrusion or lip that can engage a corresponding groove or channel in modified top and bottom plates. In another embodiment, the flanges 55 are configured to engage a groove or channel within a modified top or bottom plate. In still other embodiments, the vanes can be held together without utilizing a top and/or bottom plate as will be described below.

With reference to FIGS. 11 and 15, the stator vane assembly 16 can further include a securing device 58. Once the modular stator vanes 46 are arranged within the bottom plate 44 and/or top plate 42, the securing device 58 can be wrapped through or around the collection of modular stator vanes 46 through openings 60 in the modular stator vanes 46. The securing device 58 can act to securely, and in some embodiments releasably, hold the modular stator vanes 46 in place once the stator vane assembly 16 is fully assembled. In at least some embodiments, the securing device 58 can comprise a plastic tie strap, which can be tightened and/or fastened, and can quickly and easily be removed to facilitate disassembly of the stator vane assembly 16. In the illustrated embodiment, only one securing device 58 is shown. However, it is anticipated that in other embodiments additional securing devices can be provided. Moreover, in some embodiments, the securing device 58 can be used to secure the vane assembly 16 together without the use of top and/or bottom plates 42, 44.

Use of separate components, which can be assembled and, in some embodiments, disassembled as described above, provides numerous advantages. For example, if the modular stator vanes 46, bottom plate 44, and top plate 42 were molded together in one process, molding could be more difficult and expensive than if each component was made separately and assembled later. Thus, there is an advantage in having multiple components which can be molded separately and assembled together to create a stator assembly 16. The illustrated arrangement also reduces storage costs as the individual vanes 46 can be stacked on top of each other when disassembled. Additionally, by using separate pieces, the stator assembly 16 can be disassembled and reassembled quickly and easily, saving space and time should the components need to be stored, packaged, and/or shipped.

Additionally, by using separate pieces, the columnar air moving device 12 can be arranged and configured in various ways, and different components from one assembly 16 can be substituted for or replaced with other components from other assemblies 16. For example, different sized modular stator vanes 46 can be used in the same assembly, and/or stator vanes 46 which have different lips and/or grooves 54, 56 can be used. As described above, using modular stator vanes 46 with different lips and/or grooves 54, 56 can create different angles between the modular stator vanes 46 once the modular stator vanes 46 are assembled, thereby affecting the flow pattern of the air moving through the stator assembly 16 and/or device 12.

While the foregoing written description of embodiments of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiment and method, but by all embodiments and methods within the scope and spirit of the invention as claimed.

What is claimed is:

1. A vane assembly comprising:

a top or bottom member having a cup-like shape; and a plurality of vane members; each vane member having a top edge, a bottom edge, an outer lateral edge, an inner lateral edge, and an elongated flange extending along the inner lateral edge, the elongated flange having a top end and a bottom end, wherein the plurality of vane members are arranged in a circular pattern around a longitudinally extending axis such that the vane members point in a generally radial direction away from the longitudinal axis with the top or bottom ends of the elongated flanges positioned within the top or bottom member respectively, and wherein the inner lateral edge and the top end form a top groove.

2. The vane assembly of claim 1, comprising both a top and bottom member.

3. The vane assembly of claim 2, wherein the top and bottom members comprise a flat circular bottom portion and a circumferential wall.

4. The vane assembly of claim 1, wherein the plurality of vane members comprise elongate bodies having a downstream end and an upstream end, the downstream end having a straight axial profile, and the upstream end having a curved profile.

5. The vane assembly of claim 1, wherein each elongate flange is generally perpendicular to an elongate body of the vane.

6. The vane assembly of claim 1, wherein a circumferential wall of the top member sits within the top groove.

7. The vane assembly of claim 1, wherein the inner lateral edge and bottom end of the elongated flange form a bottom groove.

8. The vane assembly of claim 7, wherein a circumferential wall of the bottom member sits within the bottom groove.

9. The vane assembly of claim 1, wherein the elongated flange comprises a lip on one side of the flange, and a groove on another side of the flange.

10. The vane assembly of claim 1, further comprising a securing device in engagement with the plurality of vane members.

11. The vane assembly of claim 10, wherein the securing device is a tie strap.

12. The vane assembly of claim 11, wherein the plurality of vane members comprise openings, the tie strap being secured through the openings.

13. The vane assembly of claim 1, wherein the plurality of vane members comprise a lip configured to matingly engage a corresponding groove in the top member.

14. The vane assembly of claim 1, wherein the plurality of vane members comprise a lip configured to matingly engage a corresponding groove in the bottom member.

15. An air moving device comprising:

a housing having an air inlet at a first end and an air outlet at a second end spaced from the first end with an air flow passage between the first and second ends;

a rotary fan mounted in the housing near the air inlet and having an impeller with a diameter and a plurality of blades that produce an air flow with rotary and axial air flow components; and a modular stator vane assembly mounted in the housing, the stator vane assembly comprising a plurality of individual modular stator vanes coupled together and arranged about a longitudinal axis of the housing and extending between the impeller and air outlet for converting the rotary component of the airflow into laminar and axial air flow in the housing, wherein the air flow exits the air outlet in an axial stream extending beyond the air outlet in a columnar pattern with minimal lateral dispersion;

wherein each modular stator vane has a top edge, a bottom edge, an outer lateral edge, an inner lateral edge, and an elongated flange extending along the inner lateral edge, the elongated flange having a top end and a bottom end.

16. The air moving device of claim 15, further comprising top and bottom members have cup-like shapes that are positioned above and below the individual modular stator vanes.

17. The air moving device of claim 16, wherein the plurality of modular stator vanes are arranged in a circular pattern at least partially within the top and bottom members.

18. The air moving device of claim 17, wherein a circumferential wall of the bottom member sits within a bottom groove of each of the modular stator vanes.

19. The air moving device of claim 16, wherein a circumferential wall of the top member sits within a top groove of each of the modular stator vanes.

20. The air moving device of claim 15, further comprising a securing device in engagement with the plurality of modular stator vanes.

21. The air moving device of claim 20, wherein the securing device is a tie strap.

22. The air moving device of claim 15, wherein the plurality of modular stator vanes comprise elongate bodies having a downstream end and an upstream end, the downstream end having a straight profile, and the upstream end having a curved profile.

23. A method of assembling an air moving device comprising:

assembling a plurality of modular stator vanes within a holding member, each modular stator vane having a top edge, a bottom edge, an outer lateral edge, an inner lateral edge, and an elongated flange extending along the inner lateral edge, the elongated flange having a top end and a bottom end;

arranging the plurality of modular stator vanes in a circular pattern around a longitudinally extending axis such that the modular stator vanes point in a generally radial direction away from the longitudinal axis with either the top ends of the elongated flanges or the bottom ends of elongated flanges being positioned within the holding member;

mounting the modular stator vanes and holding member within a housing of the air moving device; and mounting a rotary fan in the housing above the modular stator vanes and holding member, and near an air inlet of the housing, the rotary fan having an impeller with a diameter and a plurality of blades that produce an air flow with rotary and axial air flow components.

24. A vane assembly comprising:

a top or bottom member having a cup-like shape; and a plurality of vane members; each vane member having a top edge, a bottom edge, an outer lateral edge, an inner lateral edge, and an elongated flange extending along the inner lateral edge, the elongated flange having a top end and a bottom end, wherein the plurality of vane members are arranged in a circular pattern around a longitudinally extending axis such that the vane members point in a generally radial direction away from the longitudinal axis with the top or bottom ends of the elongated flanges positioned within the top or bottom member respectively, and wherein the inner lateral edge and the bottom end form a bottom groove.

* * * * *